United States Patent [19]

Brinker

[11] 4,348,827

[45] Sep. 14, 1982

[54] DISPLAY DEVICE

[76] Inventor: Gerald W. Brinker, 8384 Squirrelridge Dr., Cincinnati, Ohio 45243

[21] Appl. No.: 277,723

[22] Filed: Jun. 26, 1981

[51] Int. Cl.[3] ..... G09F 15/00

[52] U.S. Cl. ..... 40/607; 40/595

[58] Field of Search ..... 40/606, 607, 611, 10, 40/5, 584, 594, 595

[56] References Cited

U.S. PATENT DOCUMENTS

| | | | |
|---|---|---|---|
| 1,830,960 | 11/1931 | Philibert | 40/595 |
| 1,850,237 | 3/1932 | Marsh | 40/595 |
| 2,755,576 | 7/1956 | Golden | 40/594 |
| 2,882,629 | 4/1959 | Moebius | 40/607 |
| 3,419,977 | 1/1969 | Slavsky | 40/5 |
| 3,572,223 | 3/1971 | Vierregger | 40/607 |

*Primary Examiner*—Gene Mancene
*Assistant Examiner*—Wenceslao J. Contreras
*Attorney, Agent, or Firm*—Wood, Herron & Evans

[57] ABSTRACT

A display device for use with several types of similar articles displayed together in a large stack the composition of which as to types of articles is changed from time to time. The display device is in the form of a first sheet of material the front face of which is adapted for imprinting information concerning one of the several types of articles in the display stack. The first sheet is provided with means for accepting and supporting at least one second but smaller sheet of material the front face of which is adapted for imprinting information concerning a second one of the several types of articles in the display stack. When the second type of article is added to the display stack, the second sheet of material containing information concerning such article is added to the display device. The display device is further provided with means for supporting it in an upright position.

7 Claims, 5 Drawing Figures

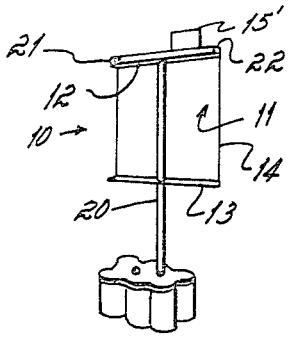
Fig. 1
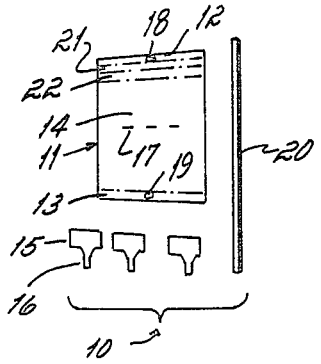
Fig. 2
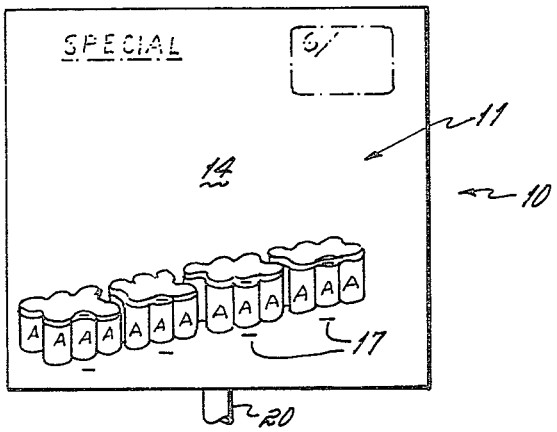
Fig. 3
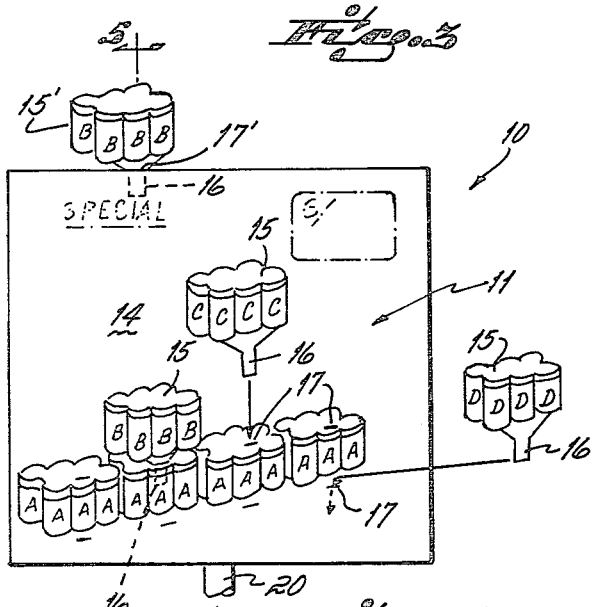
5 Fig. 4
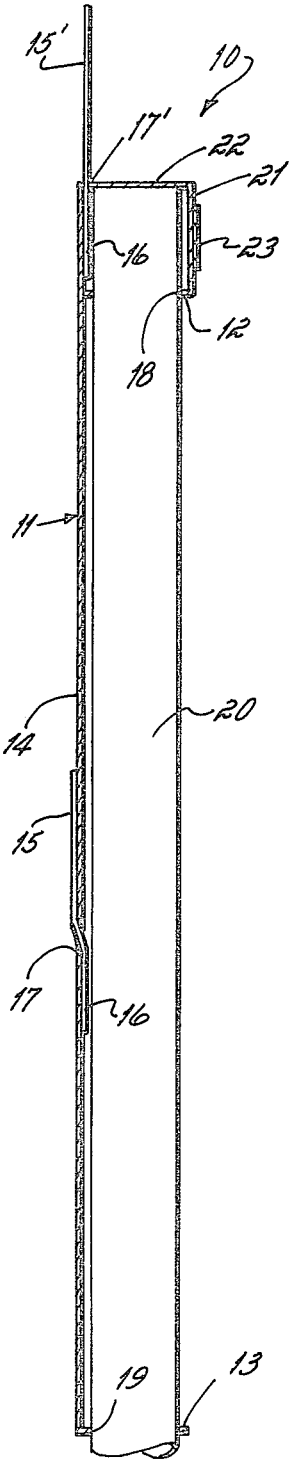
Fig. 5

DISPLAY DEVICE

BACKGROUND OF THE INVENTION

1. Field of the Invention

The present invention relate to display devices and, more particularly, to an advertising display device intended for use in conjunction with several types of similar articles displayed together in large numbers as is often done in supermarkets and the like, in which the composition of the types of articles in the display is, from time to time, modified.

2. Description of Prior Art

The prior art abounds with display devices used in supermarkets, and the like, to attract attention to different articles available in the market. Such devices usually convey pricing and other information, some of which may be required by law, as well as carry messages designed to induce purchase of the articles. They are usually used in conjunction with shelved articles, the manner in which most market articles are displayed. Display devices are also used, however, in conjunction with very high volume sales articles such as soft drinks, for instance, which are often displayed in the aisles, and similar areas of markets. Because a display device used with a shelf display must necessarily be small to be accommodated in one manner or another by the shelving, such a display device frequently is unsuited for use with aisle displays, particularly when the purpose of the display device is primarily to advertise a special sale.

Existing display devices used with high volume, aisle stacked articles are normally of large size appropriate for the stacks with which they are associated. Usually, they carry special pricing information and often carry a facsimile of the article or articles offered for sale, and, for this reason, preferably are placed as close to the stack as possible. Sometimes the display devices take the form of suspended signs where possible. Suspended signs, however, usually cannot be hung low enough to the stack to attract attention and be meaningful without at the same time interfering with movement in the aisle and about the stack. More often, the display devices take the form of self-standing signs placed on the floor alongside the stack or even on top of the stack. All of these forms, however, also have the disadvantages of either interfering with aisle movement around the stack or with movement of articles to and from the stack.

As above stated, signs used with aisle stacked articles are very often printed, on one or both sides, with a facsimile of the stacked article, in addition to pricing information and inducement messages. It is not uncommon, however, for the manufacturer or distributor of the stacked article to have similar articles of the same class, in which case the marketing retailer may wish, from time to time, to add or substract an article of the class to or from the stack. In either situation, the display devices described above as conventionally used with market aisle stacked articles are not adapted for continued use when changes are periodically made in the character of the articles of the stack with which they are associated, since provision is not made for changing the facsimiles or other printed information.

SUMMARY OF THE INVENTION

It is, therefore, an object of this invention to provide a display device for use with displays of articles stacked in aisles or similar areas of supermarkets, and the like. It is a further object of this invention to provide such a display device that can be placed close to or actually in the displayed stack of articles with which it is associated while, at the same time, minimizing any disruption to or interference with traffic about the stack, and/or movement of articles to and from the display stack. Another object is to provide a display device which can be readily modified so as to accommodate the changing character of the display stack. An additional object is to provide a display device that can be simply and easily assembled.

A display device for use in supermarkets, and the like, according to the objects of this invention comprises a flat unitary first sheet of material having front and back faces. The sheet material is provided with first horizontal creases across its width near the upper and lower ends thereof dividing the sheet into a first upper support section, a lower support section, and a center display section. Both support sections are provided at their centers with apertures which, when the support sections are folded toward the back face of the sheet to a position of 90° to the center display section, are adapted to receive means for supporting the sheet material in a vertical position.

The sheet material is also provided with second and third creases near its upper end but below the first crease dividing the upper end of the sheet into second and third upper support sections. By virtue of these latter two creases, the second and third upper support sections can also be caused to fold toward the back of the sheet so that the three upper support sections when taken together with the display section can be made to form a rectangular configuration. In the modification herein described, the aperture in the first upper section can be used in the same manner as before in conjunction with the like aperture in the lower support section to accept a vertical support means for the display device.

The center display section is adapted to receive printed information and, additionally, is provided with at least one opening to receive a second, but smaller, sheet of material on which may be printed additional material concerning articles in the display stack. If desired, more than one such opening may be incorporated in the center display section, and similar openings may be provided in the second upper support section for use in the modification above discussed. The second sheets are preferably provided with a tab to be received by the opening for temporary attachment to the first sheet, which may be made permanent, if desired, by the use of adhesive applied to the front of the tab and the back of the remainder of the second sheet.

The device is primarily intended for vertical display by the use of a rod or other means inserted through the apertures in the first upper and the lower support sections. Adhesive means, however, may be applied to the face of the second upper support section permitting attachment of the sheet to a vertical surface with or without the use of the primary support means.

BRIEF DESCRIPTION OF THE DRAWING

FIG. 1 is a pictorial representation of an assembled display device vertically positioned in a display stack of articles.

FIG. 2 is a pictorial representation of a dissembled display device.

FIG. 3 is a perspective of the first sheet material with support sections folded back and the support means inserted.

FIG. 4 is a perspective of the first sheet material as in FIG. 3 showing additionally several second sheets and the manner of insertion into the first sheet material.

FIG. 5 is an elevation taken on the line 5—5 of FIG. 4.

DESCRIPTION OF THE PREFERRED EMBODIMENT

Referring to the drawing, FIG. 1 shows the back face of the display device 10 of this invention in its assembled form mounted in a display stack of articles herein represented as metal containers, such as soft drink cans. The positioning of the display device with respect to the display stack may vary but will usually be as herein depicted. The front face of the unitary first sheet of material 11 is shown in FIG. 2 provided with horizontal creases impressed near its upper and lower ends which divide the sheet into a first upper support section 12, a lower support section 13, and a center display section 14. FIG. 2 additionally shows several second sheets of material 15 having tabs 16 for insertion in openings 17 in the central display section 14. While three such second sheets are depicted, any number of second sheets may be provided which may or may not have corresponding openings 17. As shown in FIGS. 2 and 4, the openings 17 are preferably in the form of horizontal slits of width adapted to accept and hold secure tabs 16 of second sheets 15 in a vertical position. Upper and lower support sections 12 and 13 are provided with apertures 18 and 19 for receiving support means 20. On folding support sections 12 and 13 towards the back of the sheet material 11 to a position approximately 90° to the front face of the center display section, support means in the form of a rod, or the like, can be inserted in apertures 18 and 19 to support the display device as in FIG. 1.

Turning again to FIG. 2, second and third creases are impressed at the upper end of first sheet 11 defining second and third upper support sections 21 and 22. Upper support sections 12, 21, and 22 may be of the same width, or second section 21 may be of somewhat narrower width than the other two sections thereby providing additional space to center display section 14 for display purposes. When upper support sections 21 and 22 are caused to be folded back toward the back of sheet 11 along with first upper section 12, the three sections together with center display section 14 can be made to assume a rectangular configuration as shown in FIGS. 1 and 5. This modification provides added strength to the support of the display device when placed in a vertical position by means of support 20 in apertures 18 and 19. Openings 17′, designed similarly to openings 17, may be provided in upper third support section 22 for receiving the tabs of second sheets 15′ corresponding to second sheets 15, as shown in FIGS. 1 and 5. Provision can also be made for supporting the display device without means 20 by use of an adhesive material 23 applied to the face of the second support section 21 whereby the display device can be made to adhere to any vertical surface. The two support means 20 and 23 can, of course, be used jointly if desired.

FIGS. 3 and 4 show the manner in which the display device can be altered as the character of the stack with which it is associated is changed. FIG. 3 shows the center display section of the device permanently imprinted with facsimiles of Article A. As the article stack is modified to include Articles B, and/or C, and/or D, second sheets bearing imprinted facsimiles of these additional articles are inserted in openings 17 and/or 17′ as shown in FIG. 4 By the same token, as the article stack is changed by removing a particular article or articles, the display device is similarly modified by removing the corresponding second sheets 15 and/or 15′.

Preferably, the first and second sheets 11 and 15/15′ of the display device are fabricated from paper or cardboard of sufficient weight to provide the necessary rigidity to stand upright on means 20. At the same time, the material should have sufficient flexibility to permit it to bend and return to its normal position if brushed against while placed in or near an aisle, or the like. Obviously, other materials can be used to construct the display device, such as certain plastic materials, so long as they have the required properties of rigidity and flexibility. The support means 20 can be fabricated from the same material as the rest of the display device. The adhesive means 23 is preferably a conventional pressure sensitive tape of which there are various kinds available, or can be any other suitable adhesive.

The display device of the present invention is not only simple in design and readily assembled, but the manner in which the assembled device is mounted permits its placement in association with a stack of articles in aisles and the like areas in a manner which minimizes disruption of traffic flow while, at the same time, easing the placement and removal of articles from the stack without interference from the device. The adjustable article feature of the display device, moreover, permits modifications to the subject matter of the device corresponding to changes made to the article stack, thereby eliminating the necessity and expense of completely replacing display devices with each modification to the article stack.

I claim:

1. A display device for use in conjunction with a display of several types of similar articles comprising: a first sheet of material having front and back faces; first horizontal creases extending across the width of said sheet one each near the upper and lower ends thereof dividing said sheet into a first narrow upper support section and a lower narrow support section, and a large center display section the face of which is adapted to be imprinted with information concerning one of the several types of articles in the display, said creases being of a nature as to permit the front faces of said support sections to be folded toward the back face of said center display section so as to be positioned at approximately 90° to the front face of the latter; an aperture at approximately the center of each support section for receiving means for supporting said first sheet in a vertical position; at least one slit in said sheet, and a second smaller sheet of material having front and back faces, the front face of said second sheet being imprinted with information concerning a second one of the several types of articles, said second sheet having a tab extending through said slit for securing said second sheet to said first sheet.

2. A display device according to claim 1 in which the slit is in the form of a horizontal slit in the face of the center display section, said tab extending downwardly from said second sheet, and said horizontal slit receiving the tab of the second sheet to hold the back face of said second sheet against the front face of the center display section of the first sheet.

3. A display device according to claim 2 in which the second sheet is provided with adhesive means for adherence to the first sheet.

4. A display device according to claim 2 in which second and third horizontal creases are provided across the upper end of said first sheet but below the first crease which together with the first crease form first, second, and third upper support sections, said creases permitting the front faces of said three upper support sections to be folded toward the back face of said center display section so as to form a rectangular configuration in conjunction with the center section.

5. A display device according to claim 4 in which the opening for the second sheet is in the form of a horizontal slit in the third upper support section, said opening being adapted to receive the downwardly extending tab end of the second sheet such that the second sheet extends upwardly above said first sheet.

6. A display device according to claim 1 in which the means for supporting the first sheet in a vertical position is a rod inserted through the apertures of both the first upper and the lower support sections.

7. A display device according to claim 4 in which the face of the second upper support section is provided with adhesive means.

* * * * *